US005946926A

United States Patent [19]

Hartman

[11] Patent Number: 5,946,926

[45] Date of Patent: Sep. 7, 1999

[54] VARIABLE FLOW CHILLED FLUID COOLING SYSTEM

[76] Inventor: Thomas B. Hartman, 9905 39th Dr. Northeast, Marysville, Wash. 98270-9116

[21] Appl. No.: 09/056,559

[22] Filed: Apr. 7, 1998

[51] Int. Cl.[6] ..... F25B 7/00

[52] U.S. Cl. ..... 62/201; 62/185; 236/25 A

[58] Field of Search ..... 236/25 A, 25 R; 62/185, 201; 165/218

[56] References Cited

U.S. PATENT DOCUMENTS

| | | | |
|---|---|---|---|
| 3,780,532 | 12/1973 | Norbeck et al. | 62/201 |
| 4,282,718 | 8/1981 | Kountz et al. | 62/115 |
| 4,327,559 | 5/1982 | Spethmann | 62/179 |
| 4,495,777 | 1/1985 | Babington | 62/185 |
| 4,589,060 | 5/1986 | Zinsmeyer | 364/148 |
| 5,070,704 | 12/1991 | Conry | 62/201 X |
| 5,309,727 | 5/1994 | Duff et al. | 62/201 X |
| 5,600,960 | 2/1997 | Schwedler et al. | 62/185 X |

OTHER PUBLICATIONS

Thomas B. Hartman, "Design Issues of Variable Chilled–Water Flow Through Chillers" (Ashrae Transactions 1996).

*Primary Examiner*—Henry Bennett
*Assistant Examiner*—Marc Norman
*Attorney, Agent, or Firm*—Stoel Rives LLP

[57] ABSTRACT

The present invention improves efficiency, and thereby save energy, in compressed fluid types of cooling systems, avoids instability in chiller controls, and thus provides for stable operation of a chiller in a cooling system, and provides a novel, improved single-circuit, chilled fluid cooling system that incorporates a variable flow chilled water distribution system without encountering control instability while obviating the need for constant high flow rates through a chiller by providing methods and apparatus for stable operation at reduced and variable flows.

31 Claims, 6 Drawing Sheets

VARIABLE FLOW CHILLED FLUID COOLING SYSTEM

FIELD OF THE INVENTION

This Invention pertains to the field of compression type liquid chilling systems of the type employed for comfort conditioning for buildings in variable flow applications. More specifically, the present invention is directed to methods and systems for improving the overall operating efficiency of such compression type liquid chilling systems, while also eliminating control stability problems.

BACKGROUND OF THE INVENTION

The use of compression type water chillers is the most common method of providing cooling for medium and large commercial and institutional buildings. Compression type water chillers are most commonly electric driven, but may also be driven by an engine or other power source. Electric driven water chillers are used extensively in individual buildings, campuses and district cooling plants to provide chilled water for comfort conditioning. Compression type water chillers have been employed for comfort conditioning for more than 75 years. There are several different types of compressors employed in water chillers, the centrifugal water chiller employs a centrifugal pump to compress the refrigerant and is generally the most efficient type for comfort conditioning purposes. Other types of water chillers include screw and scroll and reciprocating chillers which employ those types of compressors to compress the refrigerant.

FIG. 1 illustrates the major components of typical water chillers. In a compression type water chiller, a motor or engine (109), which is generally an electric motor, drives the compressor (110), which draws low pressure refrigerant gas from the cooler such as an evaporator (124), compresses it, and discharges it as a higher pressure hot gas via line (112) into a condenser (114). In the condenser, the hot gaseous refrigerant is condensed into a liquid by rejecting heat to tepid water from a cooling tower, or directly to outdoor air through a type of exchanger that is not shown. Water from the cooling tower (not shown) is received at condenser inlet (116) at, for example, 85 degrees F. The water leaves the condenser at outlet (118) at, for example, approximately 95 degrees F. having received heat rejected by the cooling refrigerant.

The condensed liquid refrigerant exits the condenser 114 at outlet 120 and flows through an expansion device (122) that regulates the flow into the cooler (124), which is held at a low pressure by the operation of the compressor (110). The expansion valve (122) is arranged to maintain a pressure differential between the condenser side and the cooler side of the valve. The low pressure environment in the cooler causes the refrigerant to change state to a gas and as it does so, it absorbs the required heat of vaporization from the chilled water circulating through the cooler. The low pressure vapor is drawn into the inlet of the compressor via line (130) and the cycle is continuously repeated. The chilled water is circulated through a distribution system by a pump (136) to water to air cooling coils (134) to cool air, or through radiant cooling panels, for comfort conditioning, or it is circulated through other devices or equipment to provide cooling for certain processes within the building. In general, we will refer to such cooling coils or similar devices as the load.

In the prior art, there are two common arrangements for connecting water chillers into chilled water supply and distribution systems. FIG. 2 shows a typical "single circuit" arrangement that was typically employed in earlier chilled water cooling systems. In this arrangement, a chilled water pump with check valve (210), (212), and (214) operates at a predetermined, constant flow rate, whenever its associated chiller (216), (218), and (220), respectively, is on, and prevents reverse flow when the pump is off. (Conversely, the pump is off when the corresponding chiller is off.) One or more condenser water pumps or direct outside air coils provide cooling for the condenser(s) in each chiller, but these are not shown as they are not significant to the present invention. These pumps and associated chillers together form a chilled water supply system (222).

The chilled water pump (210, 212, 214) provides water flow through the cooler of its associated chiller and to the cooling loads (230), (234), and (238) served by the cooling plant via a common supply line (224). The cooling loads, e.g. (230) are usually water to air coils that cool air serving a building, but they could be radiant cooling panels or process cooling loads. Each load is served by a corresponding three way valve (232), (236) and (240) respectively, that modulates to provide water flow through the corresponding load or bypass the flow directly back to the water chiller via a bypass line (233), (237) and (241), respectively. All of the return water flows via a common return line (244) back to the chilled water supply system (222). This arrangement provides variable flow through each load such that the cooling effect in each load can be modulated to meet the current demand, while at the same time assuring a constant flow through the cooler of the chiller(s) for stable operation.

Dual Circuit Arrangement

Another chiller arrangement that is widely employed in modern chilled water systems involves two water circuits; a constant flow primary chilled water circuit, and a variable flow secondary chilled water circuit. This arrangement is illustrated in FIG. 3. As in FIG. 2, the condenser circuit is not relevant to the invention and is not shown. The primary chilled water circuit operation is similar to the chilled water circuit in FIG. 2. A chilled water pump with check valve (310), (312), and (314) serves each chiller (316), (318) and (320) respectively. However, in FIG. 3, a separate secondary pump (328) and a decoupled secondary chilled water circuit is employed to provide chilled water flow to the loads served by the chiller plant. A decoupler line (326) ensures that differences in flows between the primary and secondary water circuits will not affect the operation of either circuit. Water flow in the decoupler line (326) will be in one direction (right to left in the figure) if the primary flow via supply line (324) exceeds the secondary flow (through the secondary pump (328), and in the opposite direction if secondary flow exceeds the primary flow. Thus the decoupler line serves as a bypass for both circuits, as needed to maintain constant flow in the primary circuit.

The primary/secondary pumping scheme of FIG. 3 has become the configuration of choice in recent years because it permits the use of variable flow two-way valves (332), (336), and (340) on the loads. In this configuration, as the requirement by the loads for cooling decreases, the water flow requirement through the secondary chilled water circuit is reduced, saving pumping power. A variable motor speed control (342) or some other pump flow modulating device is employed to adjust the flow as required in the secondary circuit. Like FIG. 2, this arrangement provides variable flow through each load such that the cooling effect in each load can be modulated to meet current demand while at the same time assuring a constant flow through the cooler of the chiller(s) in the primary circuit (322) for stable operation.

In all chiller configurations there is an emphasis on maintaining a constant flow of chilled and condenser water through the chiller at all times. For many years it was considered essential to maintain constant water flow through the chiller coolers and condensers. There are several reasons why constant water flow through the evaporators and condensers was thought to be important. One important reason is that it was thought that chiller efficiency would be adversely affected if chilled water flow were reduced under any circumstances. Recent tests, however, have shown that chiller efficiency is not necessarily adversely affected by reducing chilled water flow. It has been shown that the efficiency of at least one type of chiller is virtually identical as chilled water flow is varied from as low as 2.5 fps (feet per second) to well over 9 fps. The actual range may be even higher.

Now that it is known that chilled water flow can be varied in chillers without loss of efficiency, new simpler chiller configurations that require less pumping power at reduced loads have been suggested. Such a configuration is shown in FIG. 4. In FIG. 4, multiple chillers (411), (412), and (413) can be operated with a single chilled water pump (417) that is connected to a variable speed motor drive (418) with two way valves (431), (432), and (433) employed to modulate water flow through the loads (434), (435), and (436). In Figure four, only a single pump is required, and the water circuit is very similar to that of FIG. 1 except the system adjusts flow through the chillers as well as the loads. As the load decreases, the need for chilled water flow is decreased and the pump is slowed down, reducing energy use. As flow decreases, individual chillers can be shut down and flow through them is stopped by closing their associated valve (414), (415), and (416). Flow rate thresholds are established for starting or stopping additional chillers and when the flow through chillers sequenced on is less than the stop threshold for the total chillers on, one of the "on" chillers is sequenced off. This is a simpler and more energy efficient configuration than in use today, but it is only rarely employed because the variable flow of water through the chillers has the potential of unstable control of the chiller in response to load changes.

Controlling Chiller Plant Operation

The standard method of control of nearly all water chillers, no matter what type of configuration they are in, is to operate them to maintain a specific chilled water temperature leaving the chiller. A control diagram of this type is shown in FIG. 5. In some installations the chilled water setpoint is reset according to conditions at the load to make the chiller operate more efficiently, particularly during periods of low load. It is known that elements of a chiller plant can be considered together for operation to optimize the overall efficiency of the system. Examples of such prior art are U.S. Pat. No. 5,600,960, in which a cooling tower leaving water temperature is calculated and maintained, and U.S. Pat. No. 4,327,559, in which the chilled water temperature is adjusted to optimize the overall energy use of a chiller and air system.

It is also known to use a microprocessor or other type controller to control the capacity of the compressor in a chiller in response to supply chilled water temperatures as shown in the chiller control diagram of FIG. 5. In FIG. 5, a water temperature sensor (510) located near the chilled water outlet (511) senses the chilled water temperature leaving the chiller. A similar water temperature sensor (512) located near the chilled water inlet (513) senses the chilled water temperature returning to the chiller from the loads. A controller (514) regulates the operation of the compressor (515), and in some cases the speed of the compressor motor or engine (516), in various ways depending on the type of compressor employed, to increase or decrease the cooling effect being produced by the chiller so as to maintain a constant preset chilled water temperature setpoint.

The inlet chilled water temperature sensor (512) is employed to stabilize the control by sensing changes in the load served by the chiller. If the return chilled water temperature rises, the controller increases the chiller capacity because the load is increasing, and conversely, if the return chilled water temperature falls, the controller decreases the chiller capacity because the load is decreasing. One example of such a prior art feedback system is shown in U.S. Pat. No. 4,274,264. Other methods are employed as well to stabilize chiller control. Stabilizing control based on chilled water temperature rate of change (U.S. Pat. No. 3,780,532), and by providing a change in capacity based on deviation from setpoint of the chilled water temperature (U.S. Pat. No. 4,589,060) are known.

However, if the chilled water flow through the chiller cooler becomes variable, then the ability of any of these methods to accurately predict or adjust to changes in the load are lost and unstable operation may develop. For example, in a variable flow distribution system, an increase in return chilled water temperature may be the result of a decrease in flow and not an increase in load. In fact, the load may actually be decreasing, which is causing the flow to decrease. The resulting instability in chiller control in such circumstances has resulted in the avoidance of the simpler and more efficient chiller configurations, and is effectively blocking the implementation of more efficient variable flow chiller plant configurations.

SUMMARY OF THE INVENTION

In view of the foregoing background discussion, a broad object of the present invention is to improve efficiency, and thereby save energy, in compressed fluid types of cooling systems.

Another object of the invention is to avoid instability in chiller controls, and thus provide for stable operation of a chiller in a cooling system.

A more specific object is to provide a novel, improved single-circuit, chilled fluid cooling system that incorporates a variable flow chilled water distribution system without encountering control instability.

A still further object of the invention is to obviate the need for constant high flow rates through a chiller by providing methods and apparatus for stable operation at reduced and variable flows.

One aspect of the present invention is embodied in a chilled water cooling system that includes a chilled water generating system having an inlet conduit and an outlet conduit for generating chilled water. A supply line is connected to the outlet conduit to receive the chilled water and supply it to a variable-flow chilled water distribution system. The distribution system receives all of the chilled water—there is no bypass line around it.

A return line carries all of the return water directly from the distribution system back to the inlet conduit of the chilled water generating system, so that the return water is isolated from the outlet conduit of the generating system. Thus a change in flow rate through the distribution system is reflected in a corresponding change in flow rate into the generating system. A variable-flow pump in the return line pumps the return water into the inlet conduit; and control means are provided for controlling the variable-flow pump in response to the water flow rate through the distribution system. In this system, the chilled water generating system includes means for varying its capacity responsive to the flow rate of the return water into the inlet conduit, thereby forming a single-circuit cooling system.

In one embodiment, the means for controlling the variable-flow pump responsive to water flow rate through the distribution system includes a differential pressures sensor for controlling the variable-flow pump responsive to differential pressure across the distribution system. In another embodiment, the distribution system includes a valve connected to the supply line for modulating flow to the load and the control means for controlling the variable-flow pump includes means for controlling the variable-flow pump responsive to a setting of the said valve.

Another aspect of the present invention provides a new method of controlling chillers when they are installed in a variable flow configuration. The present invention provides an increase in overall chiller distribution operating efficiencies, and eliminates the unstable control problem at low flows that occurs with current temperature control methods.

In variable flow chilled water distribution systems, chilled water flow varies with load. This invention provides chiller control based on the chilled water flow requirements; as chilled water flow increases to serve rising loads, the capacity of the chiller is adjusted upward. Similarly, as chilled water flow decreases, the result of decreasing loads, the capacity of the chiller is adjusted downward. Chilled water temperature is not directly controlled with this invention. However, should the operation of the chiller reach one or more predetermined limits, such as the condition that the temperature of the chilled water approaches a point where freezing in the cooler could occur, then limiting algorithms override the operation until conditions move away from the predetermined limits.

Accordingly, another aspect of the invention comprises a chiller for use in a single-circuit, variable-flow chilling system. The improved chiller includes: an inlet conduit for receiving return fluid; an outlet conduit for supplying chilled fluid to a supply line; control means for varying a capacity of the chiller; and the control means is responsive to a current flow rate of the fluid through the chiller.

A still further aspect of the invention thus can be described as a chilled fluid method of cooling a load comprising the steps of:

providing a variable-capacity chiller for chilling a fluid;

pumping substantially all of the chilled fluid to the load without bypassing the load;

pumping substantially all of the return fluid from the load to the chiller, without bypassing the chiller, thereby forming a single-circuit cooling system;

varying a flow rate of the fluid through the single-circuit cooling system responsive to a current demand level of the load; and varying the capacity of the chiller responsive to the flow rate of the fluid through the cooling system, so that cooling efficiency is improved because both pumping power consumption and chilling power consumption are modulated responsive to changes in the demand level of the load.

The foregoing and other objects, features and advantages of the invention will become more readily apparent from the following detailed description of a preferred embodiment which proceeds with reference to the drawings.

DETAILED DESCRIPTION OF A PREFERRED EMBODIMENT

Figure 1:
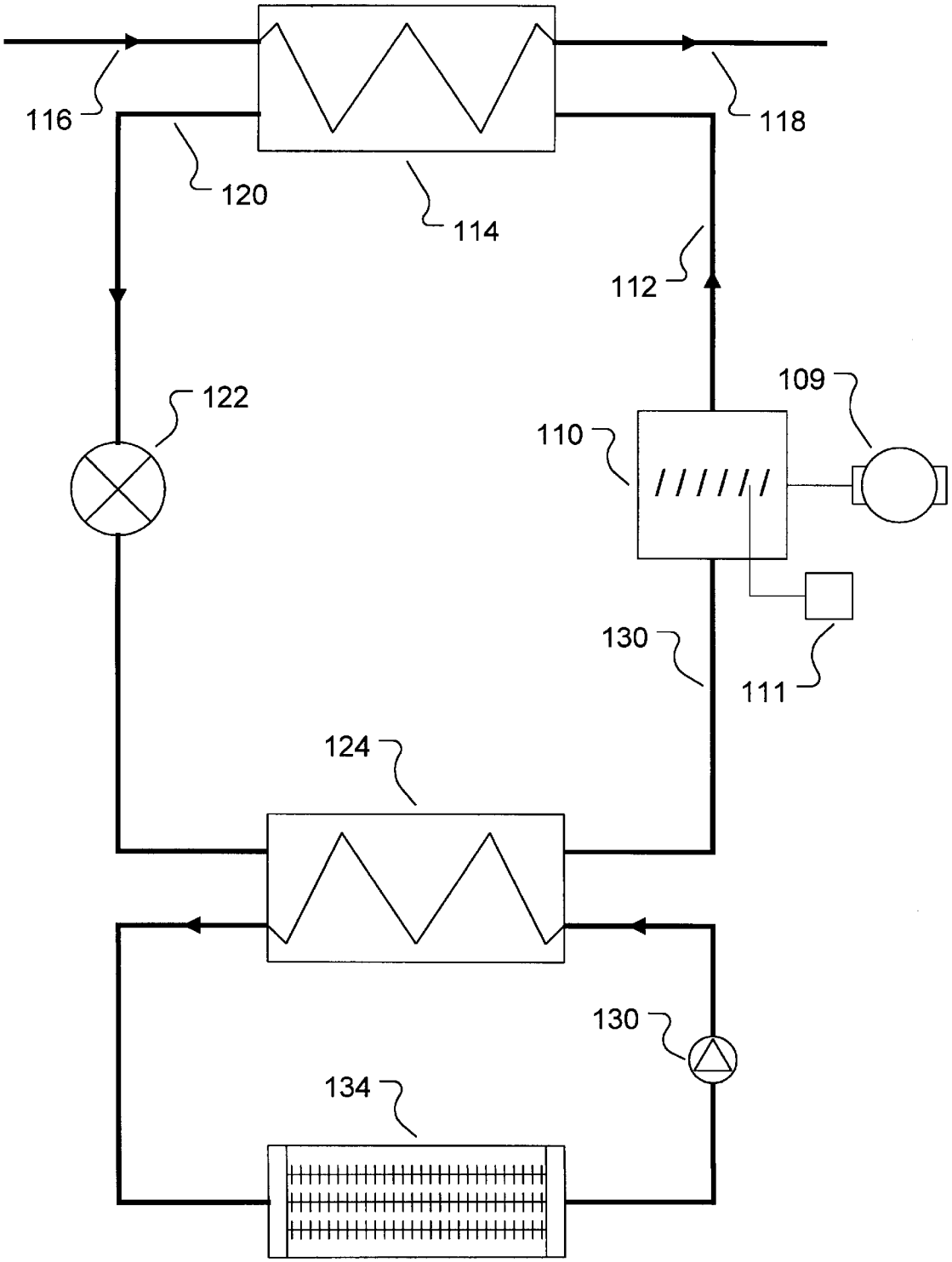
FIG. 1 (Prior Art)
FIG. 1 is a schematic of a typical prior art compression type water chiller used for providing chilled water for comfort cooling in buildings.
Figure 2:
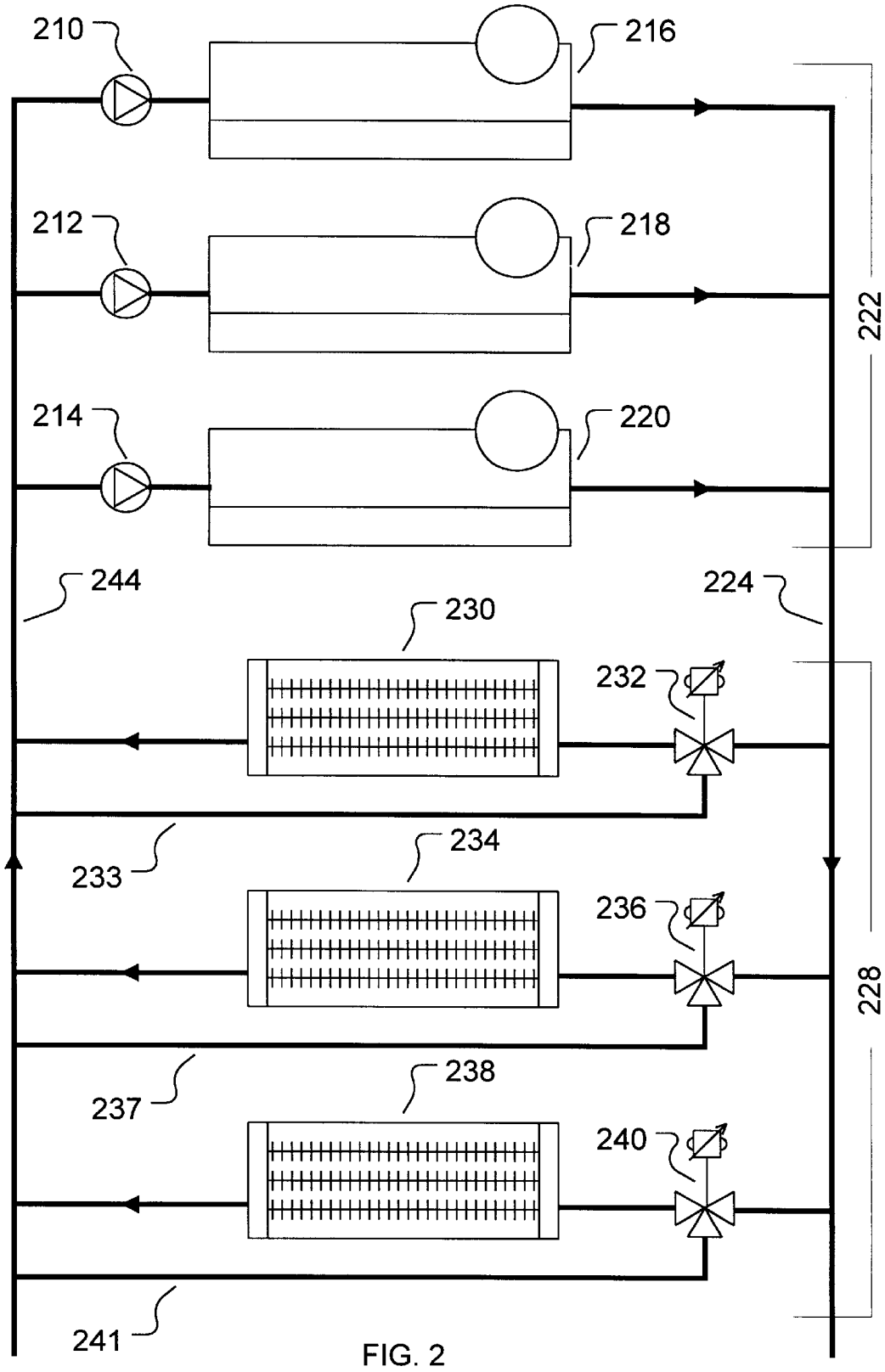
FIG. 2 (Prior Art)
FIG. 2 is a schematic of a prior art type of chilled water system used for generating and distributing chilled water for comfort cooling in buildings.
Figure 3:
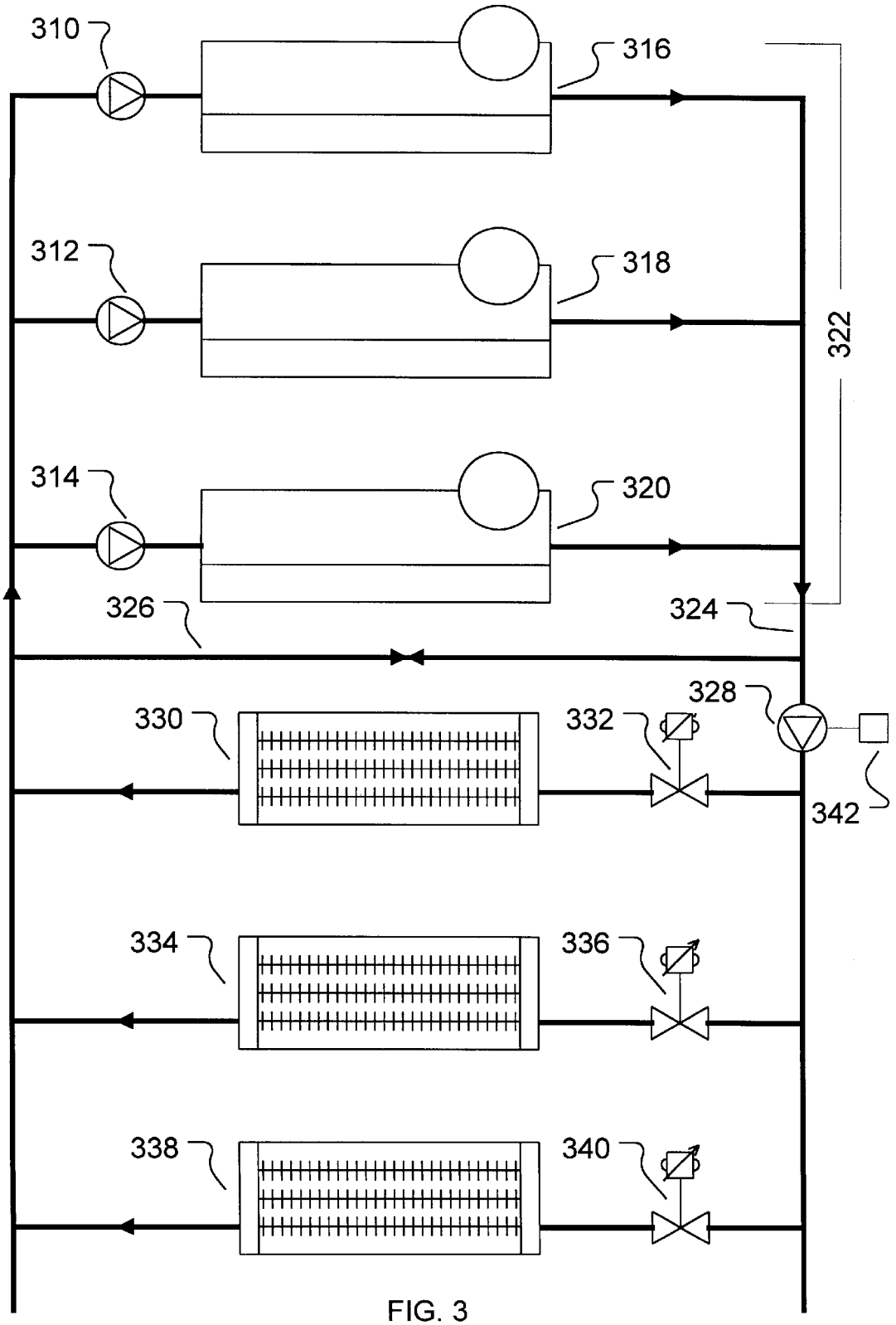
FIG. 3 (Prior Art)
FIG. 3 is a schematic of another prior art type of chilled water system used for generating and distributing chilled water for comfort cooling in buildings.
Figure 4:
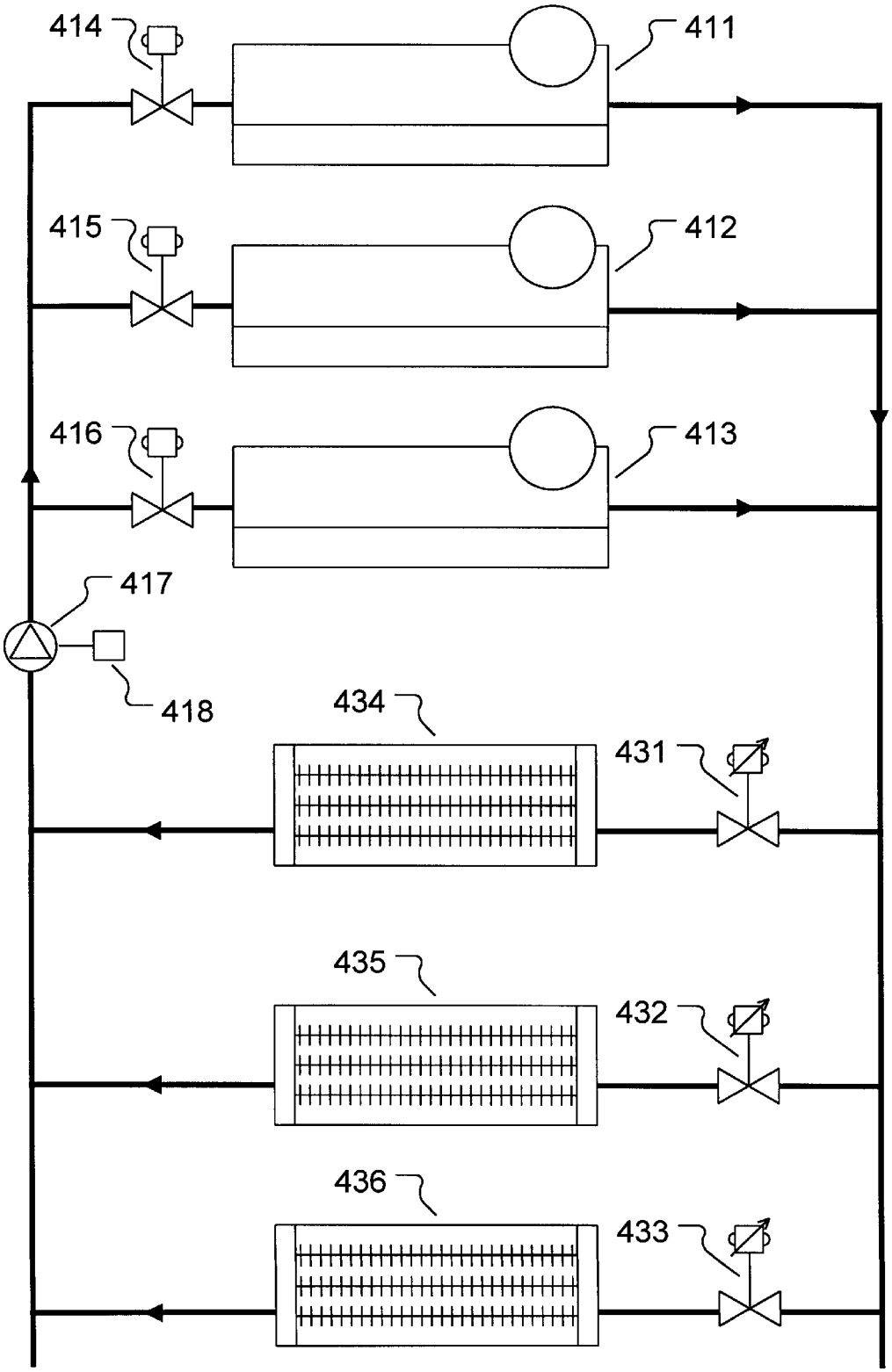
FIG. 4 (Prior Art)
FIG. 4 is a schematic of an improved chilled water system in a presently preferred embodiment according to the present invention.
Figure 5:
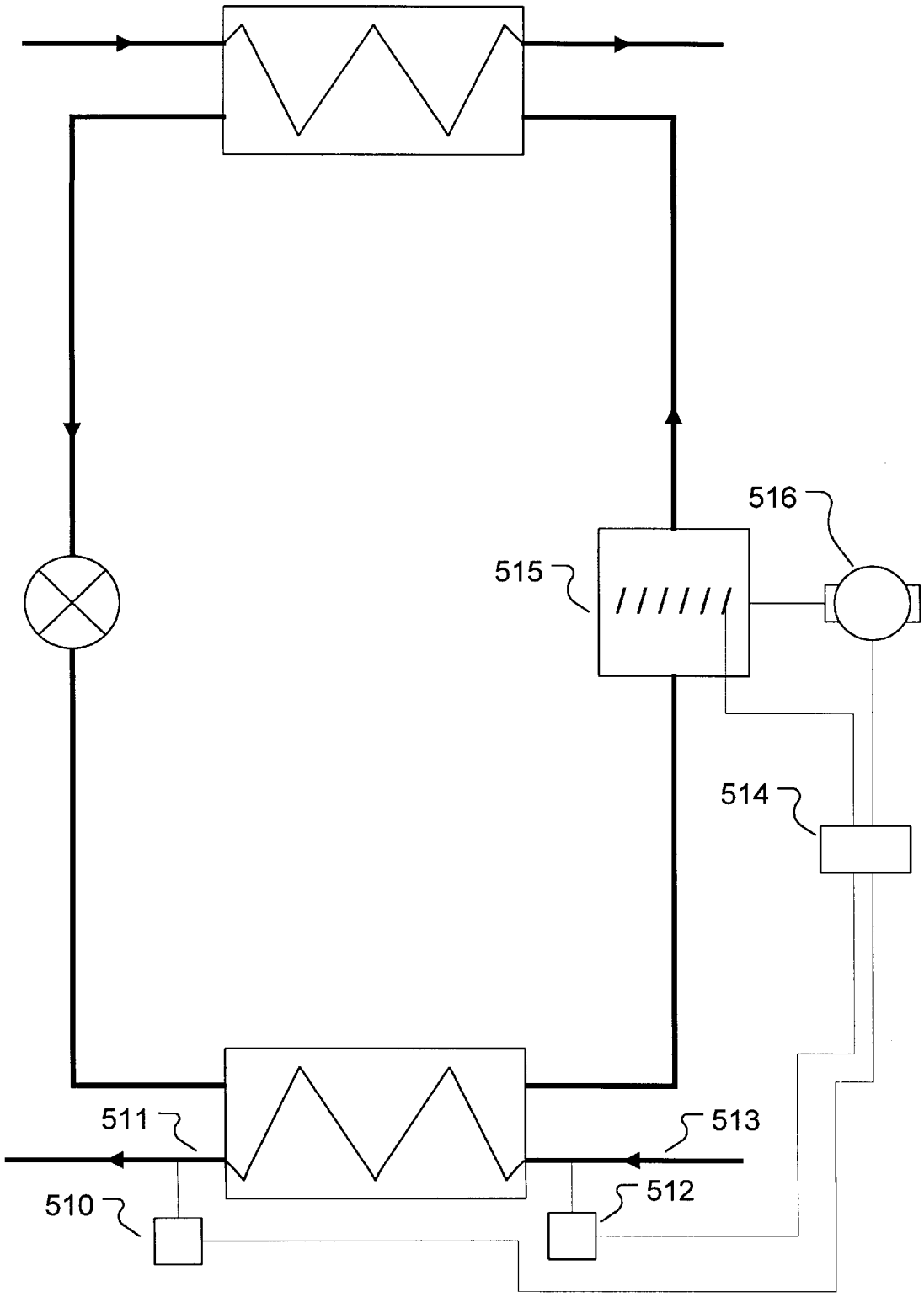
FIG. 5 (Prior Art)
FIG. 5 is a schematic diagram of a control scheme for a typical chiller.

FIG. 4 shows a simple chilled water generation and distribution system. This system employs only a single chilled water pump (417) that pumps the water through the chillers (411), (412) and (413) as well as through the cooling loads (434), (435), and (436). The pump incorporates variable flow which is preferably accomplished with an alternating current variable frequency drive (418), but could be accomplished by an number of different existing technologies. Control of chilled water flow through the loads is accomplished with modulating two-way valves (431), (432), and (433) which are modulated by controllers that are not part of this invention to meet the load requirements of the systems they serve. A suitable control scheme is employed to control the flow of water such that adequate flow exists at all times in the system. This type of control is known and may employ either a static pressure sensor that maintains a certain pressure head at one or more of the valve inlets, or preferably, a control network that senses the position of each valve served and automatically increases the flow of water anytime one or more valves approach the full-open position, and decreases the water flow anytime no valve is more than approximately 80% open. Chillers that are not currently operating are isolated from the system by closing their associated isolation valve (414), (415), and (416). Thus in this system, as the demand for cooling increases, one or more of the modulating two way valves (431), (432), and (433) open more widely, and the flow of water is increased to meet the increased cooling load.

As described before, the configuration of FIG. 4 is not recommended and rarely employed because conventional chiller control entails maintaining a specified chilled water temperature which can lead to unstable operation under certain conditions in variable flow applications. This invention entails a new method of control that permits the FIG. 4 configuration to operate with excellent stability and therefore improves the efficiency of chilled water system. In one embodiment of this invention, a flow sensor of existing technology is installed in the chilled water piping to each chiller. Such flow sensor could be incorporated into the chiller, or mounted apart on the line to or from the chiller. In this invention, the chiller capacity control is not regulated to maintain a chilled water temperature, but in response to the flow of water through the chiller, such that as the flow through the chiller increases, the chiller capacity is increased, such that at maximum flow, the chiller is operating at maximum capacity. Similarly, as the flow through the chiller decreases, the chiller capacity is decreased. The exact algorithm employed to establish the relationship between chilled water flow and chiller capacity depends on the design and maximum/minimum flows required by each chiller. For example, the chiller capacity control varies the capacity of the chiller as an exponential function of the current flow rate defined as a percentage of a predetermined maximum flow rate.

A second embodiment of this invention is the same FIG. 4 configuration except there is no flow sensor or meter associated with each chiller. Instead there is a power sensor on the chilled water pump. In this embodiment, each chiller is regulated as a function of the total pumping power expended and the number of chillers that are operating or experiencing flow.

Figure 6:
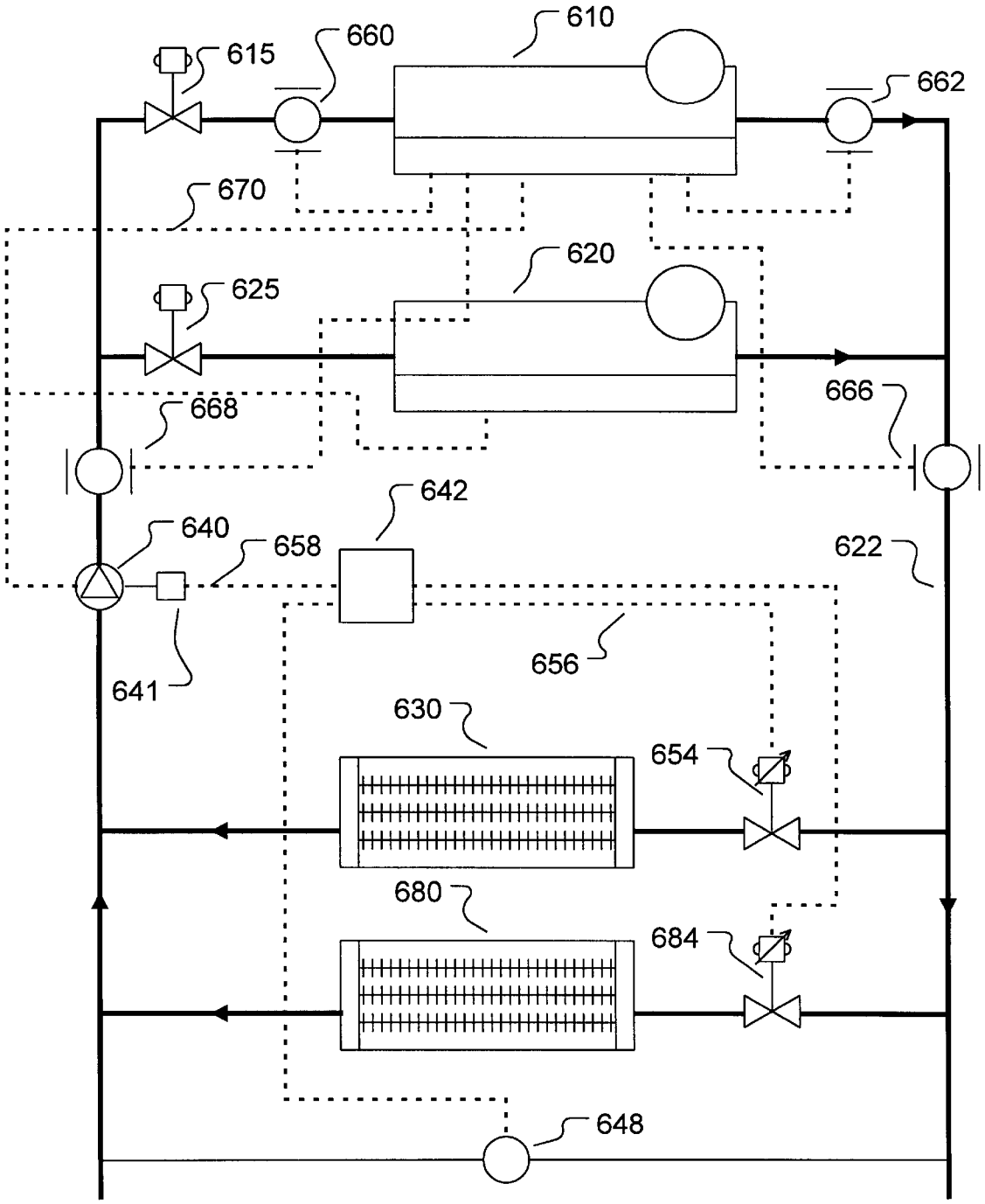
FIG. 6 is a simplified diagram of a chilled fluid cooling system including various control configurations according to the present invention.

FIG. 6 illustrates a chilled fluid cooling system according to the present invention in which the chilled water generating system includes a chiller 610 and a second chiller 620 both connected to a common supply line 622. Supply line 622 serves a variable-flow chilled water distribution system that includes a load 630 and 680 that are served by corresponding two-way modulating valves 654 and 684. A variable flow pump 640 in the return line pumps return water back to the chilled water generating system at a variable flow rate responsive to a control means 642, as indicated by a control signal path 658 from the control means 642 to an alternating current variable frequency drive 641, or some other pump flow modulating device such as a motor speed control, of the pump 640. This may be implemented, for example, using a microcontroller. Although only two chillers 610, 620, are shown for illustration, the generating system can include additional units. Additional loads can also be connected to the distribution system.

Importantly, the control means 642 controls the variable control pump 640 responsive to water flow demand of the distribution system. This can be done in several ways. For example, the control means can respond to water flow demand through the distribution system by measuring a flow rate of the fluid through the load by use of a differential pressure sensor indicated by 648, for controlling the pump responsive to differential pressure across the distribution system. In another embodiment, the control valves 654 and 684 for the loads 630 and 680 communicating with control means 642 control the pump 640 responsive to a current position setting of these valves as communicated by a signal path indicated as a dashed line 656. Where the distribution system includes multiple valves connected to the supply line for modulating flow to corresponding loads, the control means 642 can be arranged for controlling the pump 640 responsive to the settings of one or more of the distribution system valves.

It should also be noted that the variable flow pump 640 can be implemented using a plurality of individual pumps arranged for operation in concert, i.e., so that the multiple pumps change flow rates together. In another embodiment, the variable flow pump 640 can be disposed in the supply line 622. Because the system described is a single circuit, moving the variable flow rate pump to the supply line does not make a material difference. A pump disposed in the supply line would still be controlled by control means 642 in the manner previously described.

The capacities of the chillers 610, 620 can be varied in response to the flow rate of the return water for example by providing a flow meter 660 disposed on the inlet conduit for measuring the flow rate of the return fluid. Alternatively, a flow meter 662 can be provided on the outlet conduit of chiller 610 for the same purpose. The chiller capacity can also be varied in response to the flow rate of return water as indicated by a flow meter 666 disposed on the supply line, or a flow meter 668 disposed on the return line. Thus, it will be appreciated by the reader that a cooling system would not likely include all of the various sensors and meters illustrated on FIG. 6 as some of them are redundant. They are merely collected on FIG. 6 for convenience. The capacities of the chillers are varied in response to flow rate by using a transducer for sensing the condenser pressure to generate a signal, a second transducer for sensing the evaporator pressure to generate a second signal and a circuit in the compressor speed controller that permits measuring the speed of the compressor to generate a third signal. A microprocessor responsive to the first, second and third signals calculates the efficiency of the compressor based on the three signals and the chiller input power is then varied to adjust for the efficiency of the compressor such that the chiller output cooling capacity reaches the desired percent of maximum output cooling capacity in response to the flow rate. FIG. 6 further illustrates a control signal path 670 for providing an indication of the present setting, motor current draw, power consumption or velocity of the variable flow pump 640 for use by the supply system chillers in adjusting capacity, since the flow rate through the pump, according to the present invention, is itself responsive to demand on the loads in the distribution system.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

What is claimed is:

1. A chilled fluid cooling system comprising:

a chilled water generating system having an inlet conduit and an outlet conduit for generating chilled water;

a supply line having first and second ends, the first end being coupled to the outlet conduit to receive the chilled water;

a variable-flow chilled water distribution system coupled to the second end of the supply line so as to receive all of the chilled water for distributing the chilled water to a load;

a return line for carrying all of the return water directly from the distribution system to the inlet conduit so that the return water is isolated from the outlet conduit of the generating system whereby a change in flow rate through the distribution system is reflected in a corresponding change in flow rate into the generating system;

a variable-flow pump in the return line for pumping the return water into the inlet conduit;

control means for controlling the variable-flow pump responsive to water flow rate through the distribution system; and wherein the chilled water generating system includes means for varying its capacity responsive to the flow rate of the return water into the inlet conduit, thereby forming a single-circuit cooling system.

2. A chilled fluid cooling system according to claim 1 wherein the control means for controlling the variable-flow pump responsive to water flow rate through the distribution system includes a differential pressure sensor for controlling the variable-flow pump responsive to differential pressure across the distribution system.

3. A chilled fluid cooling system according to claim 1 wherein the distribution system includes a valve connected to the supply line for modulating flow to the load and the control means for controlling the variable-flow pump includes means for controlling the variable-flow pump responsive to a setting of the said valve.

4. A chilled fluid cooling system according to claim 1 wherein the distribution system includes multiple valves connected to the supply line for modulating flow to the load and the control means for controlling the variable-flow pump includes means for controlling the variable-flow pump responsive to a setting of at least one of said valves.

5. A chilled fluid cooling system according to claim 1 wherein the variable flow pump comprises a plurality of individual pumps arranged for operation in concert.

6. A chilled fluid cooling system according to claim 1 wherein the variable flow pump is disposed in the supply line.

7. A chilled fluid cooling system according to claim 1 wherein the fluid comprises water.

8. A chilled fluid cooling system according to claim 1 wherein the means for varying the chiller capacity responsive to the flow rate of the return water into the inlet conduit includes a flow meter disposed on the inlet conduit for measuring the flow rate of the return fluid.

9. A chilled fluid cooling system according to claim 1 wherein the means for varying the chiller capacity responsive to the flow rate of the return water into the inlet conduit includes a flow meter disposed on the outlet conduit.

10. A chilled fluid cooling system according to claim 1 wherein the means for varying the chiller capacity responsive to the flow rate of the return water into the inlet conduit includes a flow meter disposed on the supply line.

11. A chilled fluid cooling system according to claim 1 wherein the means for varying the chiller capacity responsive to the flow rate of the return water into the inlet conduit includes a flow meter disposed on the return line.

12. A chilled fluid cooling system according to claim 1 wherein the means for varying the chiller capacity is responsive to operation of the variable-flow pump.

13. A chilled fluid cooling system according to claim 12 wherein the means for varying the chiller capacity is responsive to a current speed of the motor driving the variable-flow pump.

14. A chilled fluid cooling system according to claim 12 wherein the means for varying the chiller capacity is responsive to motor current draw of the motor driving the variable-flow pump.

15. A chilled fluid cooling system according to claim 12 wherein the means for varying the chiller capacity is responsive to a present rate of power consumption of the motor driving the variable-flow pump.

16. A chilled fluid cooling system according to claim 1 wherein the capacity control consists of adjusting the chiller input power such that it reaches a desired percent of maximum chiller power in response to the flow rate signal.

17. A chilled fluid cooling system according to claim 1 wherein the capacity control consists of:

a transducer for sensing the condenser pressure to generate a signal;

a second transducer for sensing the evaporator pressure to generate a second signal;

a circuit in the compressor speed controller that permits measuring the speed of the compressor to generate a third signal;

a microprocessor responsive to the first, second and third signals that calculates the efficiency of the compressor based on the three signals;

a method of adjusting the chiller input power to adjust for the efficiency of the compressor such that the chiller output cooling capacity reaches the desired percent of maximum output cooling capacity in response to the flow rate signal.

18. A system according to claim 1 wherein multiple chillers are employed to provide cooling and the sequencing control of chillers consists of:

establishing flow rate thresholds for starting or stopping additional chillers;

when the flow through chillers sequenced on is less than the stop threshold for the total chillers on, one of the "on" chillers is sequenced off.

19. A chiller for use in a single-circuit, variable-flow chilling system, the chiller comprising:

inlet conduit for receiving return fluid;

an outlet conduit for supplying chilled fluid to a supply line;

control means for varying a capacity of the chiller; and wherein the control means is responsive to a current flow rate of the fluid through the chiller.

20. A chiller according to claim 19 wherein the control means varies the capacity of the chiller as an exponential function of the current flow rate defined as a percentage of a predetermined maximum flow rate.

21. A chiller according to claim 20 wherein the exponential function is greater than unity.

22. A chiller according to claim 20 wherein the control means for varying the capacity of the chiller includes means for inferring the current flow rate of the fluid based on as measured with a flow meter located at the inlet or outlet.

23. A chiller according to claim 20 wherein the control means for varying the capacity of the chiller includes means for inferring the current flow rate of the fluid based on the speed of at least one pump.

24. A chiller according to claim 20 wherein the control means for varying the capacity of the chiller includes means for inferring the current flow rate of the fluid based on the power draw or motor current of at least one pump.

25. A chilled fluid method of cooling a load comprising the steps of:

providing a variable-capacity chiller for chilling a fluid;

pumping the chilled fluid to the load without bypassing the load;

pumping the return fluid from the load to the chiller, without bypassing the chiller, thereby forming a single-circuit cooling system;

varying a flow rate of the fluid through the single-circuit cooling system responsive to a current demand level of the load; and varying the capacity of the chiller responsive to the flow rate of the fluid through the cooling system, so that cooling efficiency is improved because both pumping power consumption and chilling power consumption are modulated responsive to changes in the demand level of the load.

26. A method according to claim 25 wherein said providing a chiller includes providing a variable-speed, centrifugal chiller for chilling the said fluid.

27. A method according to claim 25 wherein both steps of pumping the chilled fluid to the load and pumping the return fluid from the load to the chiller are effected using a single pump.

28. A method according to claim 25 wherein the load comprises a cooling coil disposed in an air handling unit of an air conditioning system.

29. A method according to claim 25 wherein said step of varying a flow rate of the fluid through the single-circuit cooling system responsive to a current demand level of the load includes inferring the current demand of the load by measuring a flow rate of the fluid through the load.

30. A method according to claim 25 wherein said step of varying the capacity of the chiller responsive to the flow rate of the fluid through the cooling system includes inferring the current demand of the load by measuring a flow rate of the fluid through the chiller.

31. A method according to claim 25 further comprising providing a variable-speed, centrifugal pump for pumping the fluid and wherein the step of varying the capacity of the chiller responsive to the flow rate of the fluid through the cooling system includes measuring one of current, speed and power consumption of a motor driving the pump.

* * * * *